US007527011B2

(12) United States Patent
Smith

(10) Patent No.: US 7,527,011 B2
(45) Date of Patent: May 5, 2009

(54) PROPELLERLESS SCUBA PROPULSION VEHICLE POWERED BY COMPOUND PISTON MOTOR JOINED TO OPPOSING WATER THRUSTERS PROVIDES DIVER AIR WITHOUT LIMITING DIVE TIME

(76) Inventor: James L. Smith, 420 Stafford Ave. 3D, Wayne, PA (US) 19087

( * ) Notice: Subject to any disclaimer, the term of this patent is extended or adjusted under 35 U.S.C. 154(b) by 0 days.

(21) Appl. No.: 11/728,325

(22) Filed: Mar. 26, 2007

(65) Prior Publication Data

US 2008/0242162 A1 Oct. 2, 2008

(51) Int. Cl.
*B63C 11/46* (2006.01)

(52) U.S. Cl. ..... 114/315; 440/13

(58) Field of Classification Search ..... 114/315; 440/44, 14; 405/185, 186
See application file for complete search history.

(56) References Cited

U.S. PATENT DOCUMENTS 3,066,638 A 12/1962 Andresen ..... 115/6.1
3,128,739 A 4/1964 Schultz ..... 115/6.1
3,411,474 A 11/1968 Curtis ..... 115/6.1
3,957,007 A 5/1976 Thomas ..... 114/315
4,894,942 A * 1/1990 Winkler ..... 43/4

OTHER PUBLICATIONS

Brochure by Hyde Power Systems Inc, 9340 W. Putter Court, Crystal River, FL 32629, Jan. 1987.

* cited by examiner

*Primary Examiner*—Ed Swinehart

(57) ABSTRACT

Scuba tank compressed air can now power a dual piston compound motor driving dual water thrusters of a steady pulling underwater propulsion vehicle. Motor exhaust provides diver breathing air through a demand regulator. Motor efficiency allows continual, powerful diver thrust without curtailing normal tank dive time. Lightweight vehicle can be strapped to the scuba tank for "hands free" operation or "diver held" for driving through the water. Diver controls off/on/variable speed with a simple throttle control. Propeller or battery is not required.

4 Claims, 4 Drawing Sheets

PROPELLERLESS SCUBA PROPULSION VEHICLE POWERED BY COMPOUND PISTON MOTOR JOINED TO OPPOSING WATER THRUSTERS PROVIDES DIVER AIR WITHOUT LIMITING DIVE TIME

BACKGROUND

1. Field of Invention

My invention applies to underwater propulsion vehicles used by scuba divers to propel them effortlessly through the water. My invention is powered by compressed air from the scuba tank/s.

Within my invention, is a dual piston compound motor operating in a push/return manner supplying constant thrust (continual pulling force). The pistons are secured to dual water disks used to smoothly thrust the diver through the water without need for a propeller or a battery.

The discharged air leaving the motor accumulates within a housing of my invention from which the diver breathes through a demand regulator. The device uses the energy stored within scuba tank compressed air so efficiently that dive times are not shortened by introduction of my propulsion vehicle! In other words, the diver is propelled with powerful thrust without restriction on normal "bottom time" or "down time".

A diver has options of securing my invention to their scuba tank for "hands free" operation or holding my invention in front of them to drive it though the water.

2. Description of Prior Art

Battery Propulsion Vehicles

The art of underwater diver propulsion vehicles can be divided into three fields of work.

One field can be identified as "battery propulsion vehicles". These inventions use electric motors connected to a propeller providing thrust. Batteries within a watertight housing supply stored electric energy required to operate the motor.

Disadvantages of these battery propulsion vehicles include:

A heavy weight of the batteries and the ferrous electric motor. These vehicles are heavy and cumbersome to carry and transport to and from the dive site, especially through airports, and within taxis.

A large bulky housing is required to contain the batteries and to provide buoyancy offsetting the vehicle weight. This large vessel is difficult for the diver to manipulate, and practically precludes the opportunity of attachment to the scuba tank for hands free operation.

Batteries are selected by the manufacturer of the battery propulsion vehicles to provide an amount of energy required (when charged) for about one scuba tank dive (around 45 minutes). After a dive, the diver has to return to the surface, and open the housing to install a second battery if a recharging system is unavailable on the dive boat. If the boat has a charging system, the diver must wait a long recharging time (one or two hours) before the battery is again ready. There would be significant advantages to having a smaller, lighter, diver propulsion vehicle which operated without use of electric batteries.

Air/Propeller Propulsion Vehicles

A second art field of work can be identified as "air/propeller propulsion vehicles". These vehicles attempted to make efficient use of the stored compressed air energy available in the scuba tank by operating an air motor connected to a propeller.

The inventors of some of these vehicles had the diver breathe the rotary motor exhaust so that motor exhaust air was not wasted by dumping into the water. Some inventors collected the motor exhaust air in a propulsion vehicle housing from which the diver breathed. Other inventors collected the motor exhaust air in an inflatable air bag from which the diver breathed. One example of an air/propeller vehicle is described in U.S. Pat. No. 3,128,739 by Schultz, Apr. 14, 1964. Schultz used an air motor of "conventional design". Unfortunately, a conventional design air motor cannot provide adequate propelling thrust at an air consumption rate less than a diver's breathing rate consumption for reasons to be soon explained.

Other inventors used no exhaust air accumulator at all, and relied on the motor running only with each diver inhaling.

Inventors attempted to have air motors consume less air (while operating at practical diver thrust) than a diver's breathing rate of air consumption. For with such a condition, no scuba tank air would be wasted when providing practical diver transport. If this condition was not met, and if the motor (while providing practical thrust) consumed more air than a diver's breathing rate, than the diver "bottom time" or "dive time" would be curtailed.

The two design criteria for meeting the above condition of practically can be stated:

1. Use an air motor which operates at incoming pressure as high as is practical. This practical limit should be about 200 psig represented normal thought of "empty scuba tank pressure". If one incorporated an air motor to operate above 200 psig, the scuba tank would become "empty" sooner than desired and curtail dive or bottom time.
2. Use an air motor which exhausts at as low of a pressure as possible. This practical limit will be about 15 psig. With 15 psig motor exhaust pressure, the vehicle housing can nominally operate around 10 psig without restricting motor efficiency/exhaust into the housing. Equally important, the diver can breathe easily from the housing if it operates near 10 psig using a hookah type demand regulator.

By meeting these design criteria [motor operating at "pressure in" of 200 psig, and exhausting at 15 psig], an air motor will use all the energy possible from a scuba tank throughout the entire dive time. Dive time is normally defined as the dive time where tank pressure varies from fill pressure (about 3,000 psig) to about 200 psig practical tank empty pressure.

All these prior air/propeller propulsion vehicle inventions shared a common impracticality: The rotary air motors used were not efficient enough to provide adequate diver thrust and at the same time consume scuba tank air at a rate less than the diver breathing rate. Because of this shortcoming, all prior air/propeller propulsion vehicle inventions wasted significant scuba tank air while the motor was operating at a practical thrust. This wasted air (beyond the diver's breathing rate consumption) was exhausted into the water, and cut the dive time or down time to much less than what it would be without the vehicle.

The reason why practical motor operating criteria presented above were not achieved with air motors used in prior inventions is that no commercial manufacturer of rotary air motors offers such an efficient air motor for sale!

Rotary air motors available include vane air motors being the least efficient in that the incoming air is typically 100 psig and exhaust air is typically 40 psig. All the scuba tank compressed air energy between 200 psig and 100 psig and between 40 psig and 15 psig is lost/wasted/not available for diver propulsion. In addition, vane air motor design allows a significant amount of air to slip/bypass the vane at both rotor and housing seals. Such slip/bypass air contributes nothing to motor power and wastes scuba tank air.

Wobble plate multi-piston rotary air motors are about the most efficient commercial air motor available in that incoming air can be 200 psig, but exhaust air is correspondingly about 70 psig. All the scuba tank compressed air energy between 70 psig and 15 psig is lost/wasted/not available for diver propulsion.

A commercial product called the Hydrojet is disclosed in a brochure by Hyde Power Systems, Inc. of 9340 W. Putter Court, Crystal River, Fla. 32629 of January 1987. This vehicle is powered by a five cylinder wobble plate air motor. The Hydrojet brochure describes a 50% (from 40 min to 20 min) loss of dive time if the vehicle operates at full speed (practical diver thrust).

There would be a major advantage in making a propulsion vehicle for scuba divers which used a air motor that provided both practical diver thrust and an air consumption less than the diver's breathing air consumption so dive time available from a scuba tank is not curtailed.

Single Water Disk Propulsion Vehicles

A third art field of work can be identified as "single water disk propulsion vehicles". These air powered propulsion vehicles do not use a propeller or rotary air motor to provide diver thrust. Instead, they use a single reciprocating water disk attached to a single piston motor for the thrust/power stroke.

The water disk of these inventions has attached one or more flexible flaps and a series of corresponding openings/holes through the water disk. The flaps and openings/holes cooperate so the water disk experiences nearly zero water resistance on the return stroke and maximum water resistance on the power stroke.

U.S. Pat. No. 3,411,474 by Curtis, Nov. 19, 1968 describes a single water disk propulsion vehicle using two pistons axially aligned. One piston [45] drives the water disk in the thrust direction and another opposite piston [46] drives the water disk in the return direction.

Another U.S. Pat. No. 3,066,638 by Andresen, Dec. 4, 1962 describes a single water disk propulsion vehicle using a single piston. A compressed spring [44] returns the thruster/piston combination in preparation for another thrust stroke. Andresen describes the propulsion [column 3 line 65] as "pulsating".

All these inventions share a same operational deficiency. The propulsion vehicle moves forward with intermittent forward thrusts each followed by a time period of zero thrust (as the water disk returns). As a result the diver propulsion is jerky and un-constant.

A second even more significant deficiency of all prior art single water disk propulsion vehicles is that the air piston motor is a single stage type. As such, if the motor operates at the desirable 200 psig pressure discussed above, the single piston must exhaust air at the undesirable pressure of about 80 psig. This 80 psig pressure exhaust is necessary as the single piston/single water disk must provide reasonably constant thrust throughout it's entire power stroke. The range of 200 psig to 80 psig is constant enough, but does not meet the motor practicality definition discussed above.

If one were to attempt to design a single piston long enough (over a foot long) to operate at the desired practicality pressure range of 200 psig input and 15 psig exhaust the thrust would become an order of magnitude even more jerky and un-constant. In addition, the one foot long piston when connected to another one foot long water disk would make the propulsion vehicle impractically long. There would be a major advantage in making a water disk propulsion vehicle for scuba divers which was able to have the motor operate at a pressure range of 200 psig "input" and 15 psig "exhaust" without jerky/un-constant motion and without impractical length.

SUMMARY OF MY INVENTION

General

My invention discloses an air powered underwater diver propulsion vehicle. Some of the objectives of my invention include:

Using energy available from the compressed air within the scuba tank to power the vehicle dual compound piston motor. Batteries are not required.

Connecting the dual piston compound motor to dual water disks providing diver propulsion.

Using dual water disks instead of only one water disk to achieve smooth continual propelling thrust with improved efficiency.

Using mechanical linkage between the two pistons. One piston and attached water disk is linked to be 180 degrees out of phase with the second piston and attached water disk. Unlike prior art single water disk propulsion vehicles, my invention provides continuous diver thrust and is not intermittent. Also conservation of air pressure is realized by returning the inactive piston/water disk by the driving piston/water disk.

Operating the dual piston motor at incoming air pressure with the highest pressure possible from a scuba tank normally considered "empty" at dive's end, (considered to be 200 psig).

Operating the dual piston motor exhaust air at low pressure of only 15 psig. With such a low exhausting pressure, the motor utilizes nearly all the pneumatic energy available within the 200 psig incoming air. This efficient energy utilization is accomplished by using a compound dual piston motor. A higher pressure and smaller diameter piston/cylinder (at stroke's end) exhausts into the lower pressure and larger diameter cylinder driving the larger piston through it's power stroke. This dual piston compound motor is more air efficient than any motor described by prior inventors in this art.

The air exhausted from the dual piston compound motor is collected within the vehicle housing which acts as a reservoir. Generally the invention will not exhaust/waste air into the surrounding water.

The diver is supplied with an ample supply of breathing air from the vehicle housing used in conjunction with a breathing demand regulator and hose.

Including a pressure regulator that can either add air to the housing or bleed air out of the housing into the surrounding water. This pressure regulator will compensate for instances where the diver breathing air consumption rate does not closely match the motor air consumption rate. This regulator maintains housing pressure so breathing air is always available for the diver. This regulator also controls housing pressure so it never builds up enough to inhibit full power motor operation.

Matching the vehicle housing volume to the vehicle weight providing a near neutral or a slight positive buoyancy.

Including an on/off and thrust speed control throttle, so the diver may vary their speed from zero to maximum thrust at will.

Making the vehicle light enough and small enough to be attachable to the scuba tank positioned on the diver's back, so the diver can propel "hands free".

Including another option of allowing the vehicle to be detached from the scuba tank and be driven through the water by the diver holding onto the vehicle with their hands.

Other and further objects of my invention will be apparent from the following description when read in conjunction with the accompanying drawings.

By way of example, my invention is illustrated herein by the accompanying drawings, wherein:

DRAWING FIGURES

| Names and Numbers used in Drawing Fig.'s and Specification | |
|---|---|
| 20 | large cylinder |
| 21 | large piston |
| 22 | attachment strap |
| 23a | thrust housing a |
| 23b | thrust housing b |
| 24 | flapper |
| 24a | flapper p |
| 25 | water disk |
| 25a | water disk p |
| 26 | main housing |
| 27 | push rod |
| 28 | scuba tank |
| 30a | slide block a |
| 30b | slide block b |
| 31 | pressure regulator |
| 32 | fill valve |
| 33 | pilot fill valve |
| 34 | small cylinder |
| 35 | small piston |
| 36 | arm pivot |
| 37 | pilot dump valve |
| 38 | exhaust spring |
| 39 | water spring |
| 40 | fill spring |
| 41 | fill poppet |
| 42 | piston seal |
| 43 | housing port x |
| 44 | water port |
| 45 | piston |
| 46 | passageway b |
| 47 | inlet port w |
| 48 | regulator body |
| 49 | rotating arm |
| 50 | push rod p |
| 51 | dump poppet |
| 52 | cam pivot |
| 53 | valve lobe |
| 54 | poppet spring |
| 55 | Line port b |

-continued

| Names and Numbers used in Drawing Fig.'s and Specification | |
|---|---|
| 56 | Fill poppet b |
| 57 | Mounting plate |
| 58 | poppet pin |
| 59 | fill pivot |
| 60 | pivot spring |
| 61 | travel groove |
| 62 | first stage regulator |
| 63 | demand regulator |
| 64 | check valve |
| 65 | tube a |
| 66 | tube b |
| 67 | mounting bracket |
| 68 | tube c |
| 69 | tube d |
| 70 | tube e |
| 71 | tube f |
| 72 | tube g |
| 73 | tube h |
| 74 | tube i |
| 75 | throttle connection |
| 76 | spool valve |
| 77 | exit port |
| 78 | high pressure hose |
| 79 | breathing hose |
| 80 | tube |
| 81 | throttle cam |
| 82 | pin |

DESCRIPTION OF THE PREFERRED EMBODIMENT

Pressure Regulator 31

A pressure regulator 31 in general maintains vehicle main housing 26 (shown in FIG. 4) pressure within design limits.

Figure 5:
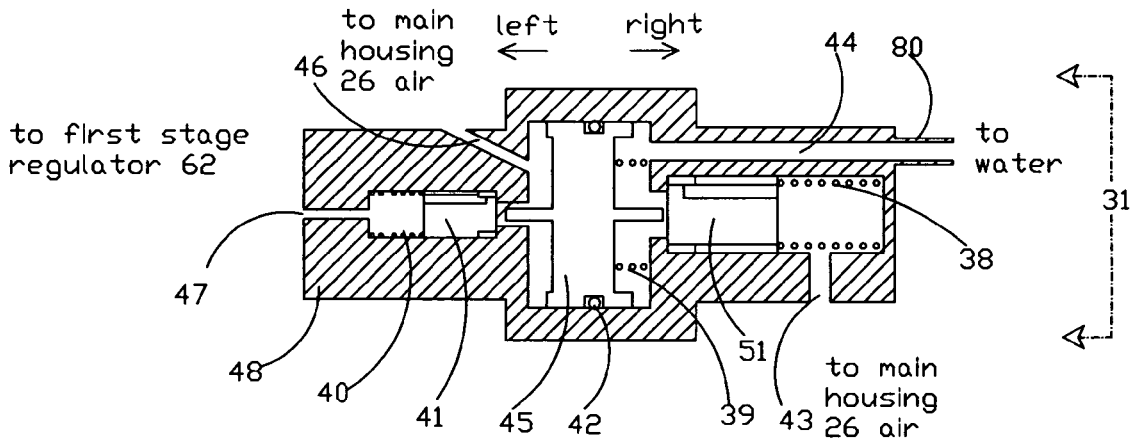
FIG. 5 shows internal component details of the pressure regulator of my invention.

FIG. 5 shows components of pressure regulator 31. A tube 80 exits on the right side of a regulator body 48. Tube 80 is in conveyance with diver surrounding water. A water port 44 through regulator body 48 conveys water to the right side of a piston 45. The internal pressure of vehicle main housing 26 is conveyed though a passageway b 46 to the left side of piston 45.

A piston seal 42 exists between piston 45 and regulator body 48. As shown, piston seal 42 is an o-ring type, but other moveable sealing components such as a diaphragm could be used. Piston seal 42 allows piston 45 to move to the left or right within a cavity in regulator body 48, yet separates pressurized air from the left side of piston 45 from water pressure on the right side of piston 45.

A fill poppet 41 is positioned to the left of piston 45. Fill poppet 41 can be made from an elastomer such as polyurethane so it's face facilitates a pressure seal with a bore face in regulator body 48. Pressurized air conveyed from a first stage regulator 62 shown in FIG. 4 enters an inlet port w 47, and is prevented from flowing to the left side of piston 45 unless piston 45 moves far enough to the left to move/unseat fill poppet 41.

A dump poppet 51 is positioned to the right of piston 45. Dump poppet 51 can also be made from polyurethane so it's face causes a pressure seal with another bore face in regulator body 48. Main housing 26 air entering a housing port x 43 is prevented from flowing to the right side of piston 45 unless piston 45 moves far enough to the right to move/unseat dump poppet 51.

A fill spring 40 forces fill poppet 41 against regulator body 48 aiding sealing. An exhaust spring 38 forces dump poppet 51 against regulator body 48 aiding sealing.

A third water spring 39 forces piston 45 to the left with enough force to overcome fill spring 40 force and unseat fill poppet 41 when main housing 26 internal pressure drops too low to supply diver breathing air supply.

When fill poppet 41 unseats, high pressure air from inlet port w 47 flows into main housing 26 through passageway b 46 thereby increasing main housing 26 pressure enough to supply sufficient diver breathing air.

As main housing 26 pressure increases, the pressure on the left side of piston 45 also increases until piston 45 moves far enough to the right to overcome water spring 39 force and allows fill poppet 41 to close off air flow to main housing 26.

Main housing 26 internal pressure is also conveyed through housing port x 43 to the right side of dump poppet 51. Whenever dump poppet 51 unseats (moves to the right), main housing 26 air exhausts past dump poppet 51, to the right side of piston 45, through water port 44 and tube 80 out into the surrounding water.

A stable pressure differential range exists between main housing 26 internal pressure and the water pressure. This designed differential range can be on the order of 3 to 10 psig. If this differential range begins to drop below about 3 psig, then piston 45 will be forced by water spring 39 to unseat fill poppet 41 and bleed air from inlet port w 47 into main housing 26 through passageway b 46 until main housing 26 pressure exceeds 3 psig. If this differential range attempts to exceeds about 10 psig, piston 45 will be forced by main housing 26 air pressure (sensed through passageway b 46) to unseat dump poppet 51 allowing main housing 26 internal pressure to bleed from housing port x 43 out water port 44 and tube 80 into the water until pressure in main housing 26 decreases below about 10 psig.

As described, pressure regulator 31 senses both water pressure and main housing 26 internal pressure. If the differential between these two pressures is not within the designed range, then pressure regulator 31 either flows additional air into main housing 26 or exhausts air from main housing 26 into the surrounding water. Pressure regulator 31 insures the diver always has sufficient air for breathing purposes.

Basic Drive Components

Figure 3:
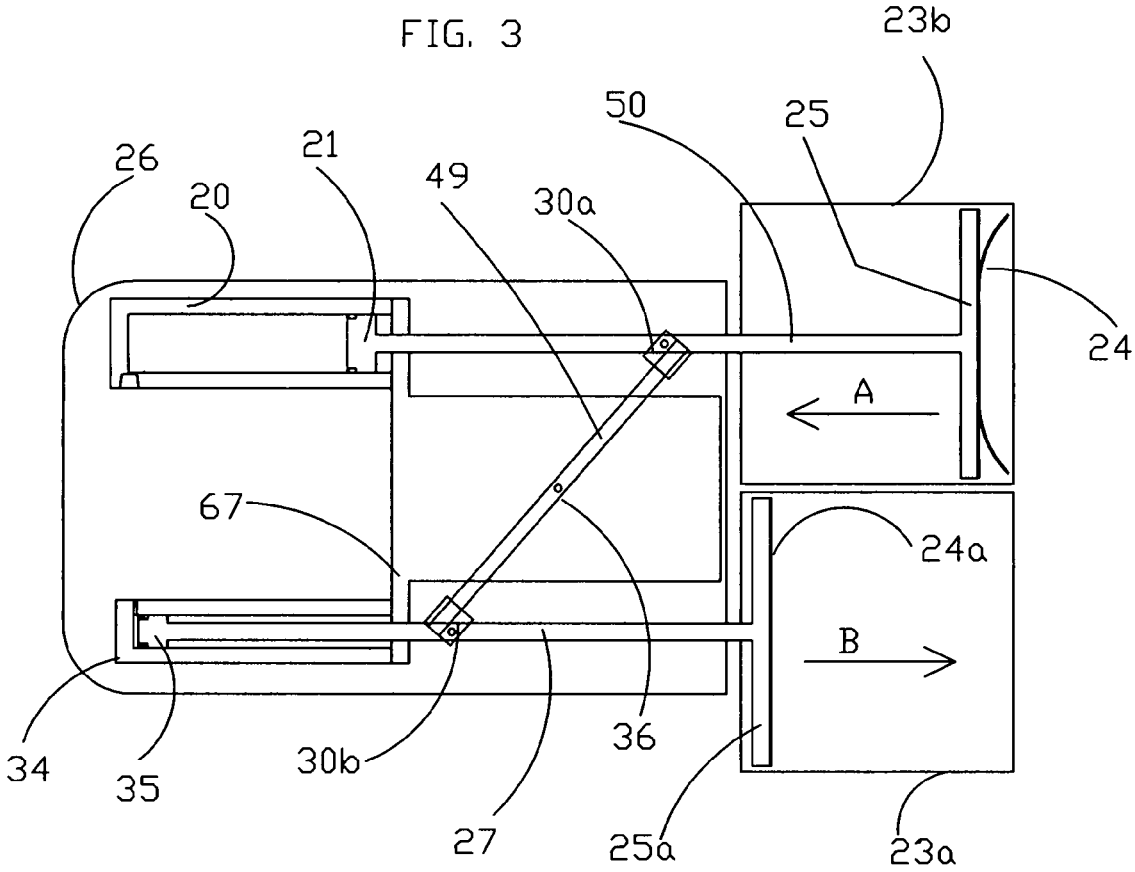
FIG. 3 shows a fragmentary sectional elevation view as suggested by lines 3-3 of FIG. 2 showing the motor/water disk components at the beginning of the small piston power stroke.

FIG. 3 shows major drive components of my invention shown just as a small piston 35 is beginning it's thrust stroke (to the right). My invention includes two drives.

One drive includes a small cylinder 34, small piston 35 connected by a push rod 27 to a water disk p 25*a*. Attached to water disk p 25*a* is a flapper p 24*a*. Flapper p 24*a* is constructed so as water disk p 25*a* moves in shown direction B, water within thrust housing a 23*a* is forced in direction B moving the diver in the opposite reaction direction A.

The second drive includes a large cylinder 20, a large piston 21 connected by a push rod p 50 to a water disk 25. Attached to water disk 25 is a flapper 24. Flapper 24 is also constructed so as water disk 25 moves in direction B, water within thrust housing b 23*b* is forced in direction B also moving the diver in the opposite direction A.

When either flapper is moving in return direction A, water flows through both the flapper and it's perforated water disk with little resistance as the flaps fold open as shown with flapper 24. The two drive systems operate out of phase with each other. As the first drive system moves in thrusting direction B, linkage comprised of a slide block b 30*b*, a rotating arm 49, an arm pivot 36 and a slide block a 30*a* moves the second drive system in direction A and visa versa. Slide block a 30*a* is slideably attached to rotating arm 49 and pivotally fixed to push rod p 50. Similarly, slide block b 30*b* is slideably attached to rotating arm 49 and pivotally fixed to push rod 27. Rotating arm 49 pivots freely about arm pivot 36.

When the first drive system moves in direction B, the linkage components return/move the second drive system in the opposite direction A and visa versa. As such, my invention provides continuous/smooth thrust as either one water disk or the other is always applying a forward thrust to the diver.

Flappers can be made from many types of elastomer/rubber like materials such as polyurethane of approximate thickness 0.04 inch. This material and thickness lets the flappers act rigid and behave like a leak proof solid when the pistons are moving in the trust direction B. The water disk 25 with attached flapper 24 should make a slideable seal with the inside of thrust housing b 23*b* so water will not bypass water disk 25 during it's stroke in thrust direction B. This seal can be effected by having a close tolerance between water disk 25 and thrust housing b 23*b* in the order of a few thousands of an inch. Alternately, the seal can be completed with an o-ring or a rolling diaphragm not shown.

Rotating arm 49 can be made from a round stainless steel shaft of diameter about 5/16 inch. Slide blocks 30*a* and 30*b* can be made from delrin plastic as delrin provides an excellent bearing with the stainless steel shaft.

Figure 1:
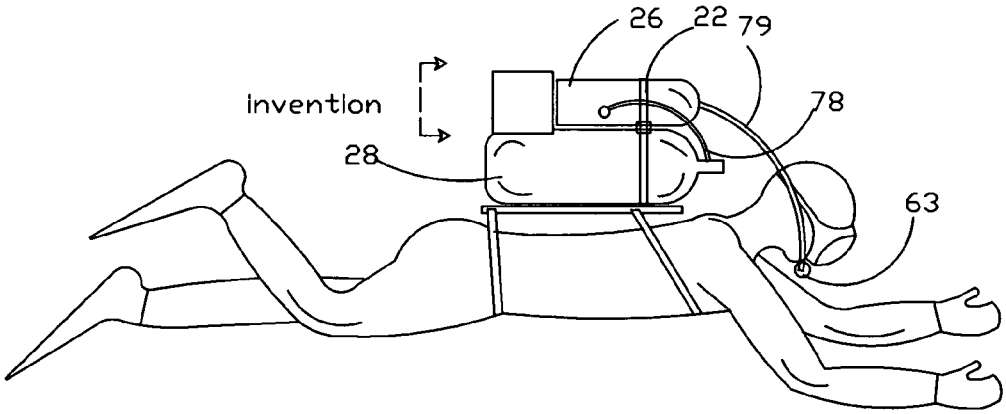
FIG. 1 is a perspective view of my invention shown attached to a scuba tank used by a diver.
Figure 2:
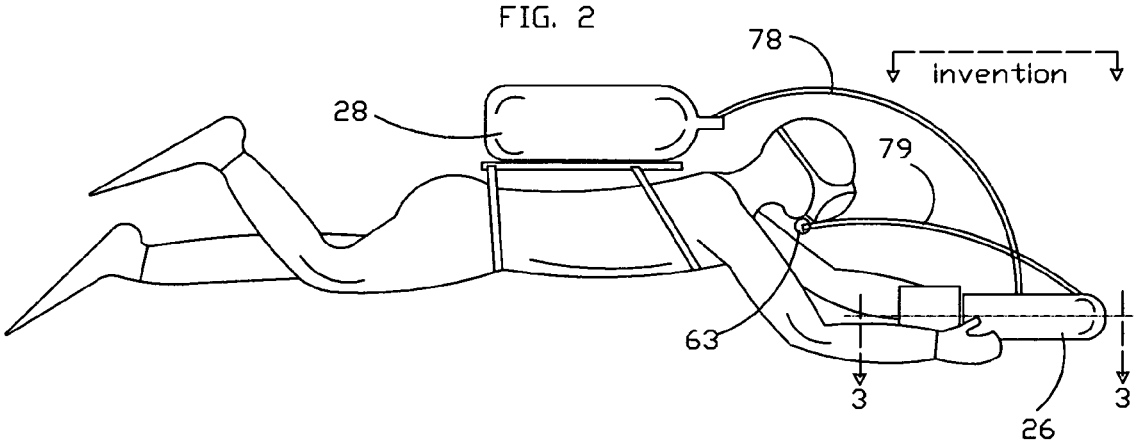
FIG. 2 is a perspective view of my invention positioned in front of a diver.

My invention as shown in FIG. 2 may be guided through the water by the diver. Alternately, my invention may be attached to a scuba tank 28 with a simple mechanism such as an attachment strap 22 shown in FIG. 1. A supplier for attachment strap 22 with a suitable spring loaded detachable catch is model SC-B-83314-42, manufactured by Nielsen Hardware Corp., 770 Wetherfield Ave., Hartford, Conn., 06101.

Figure 4:
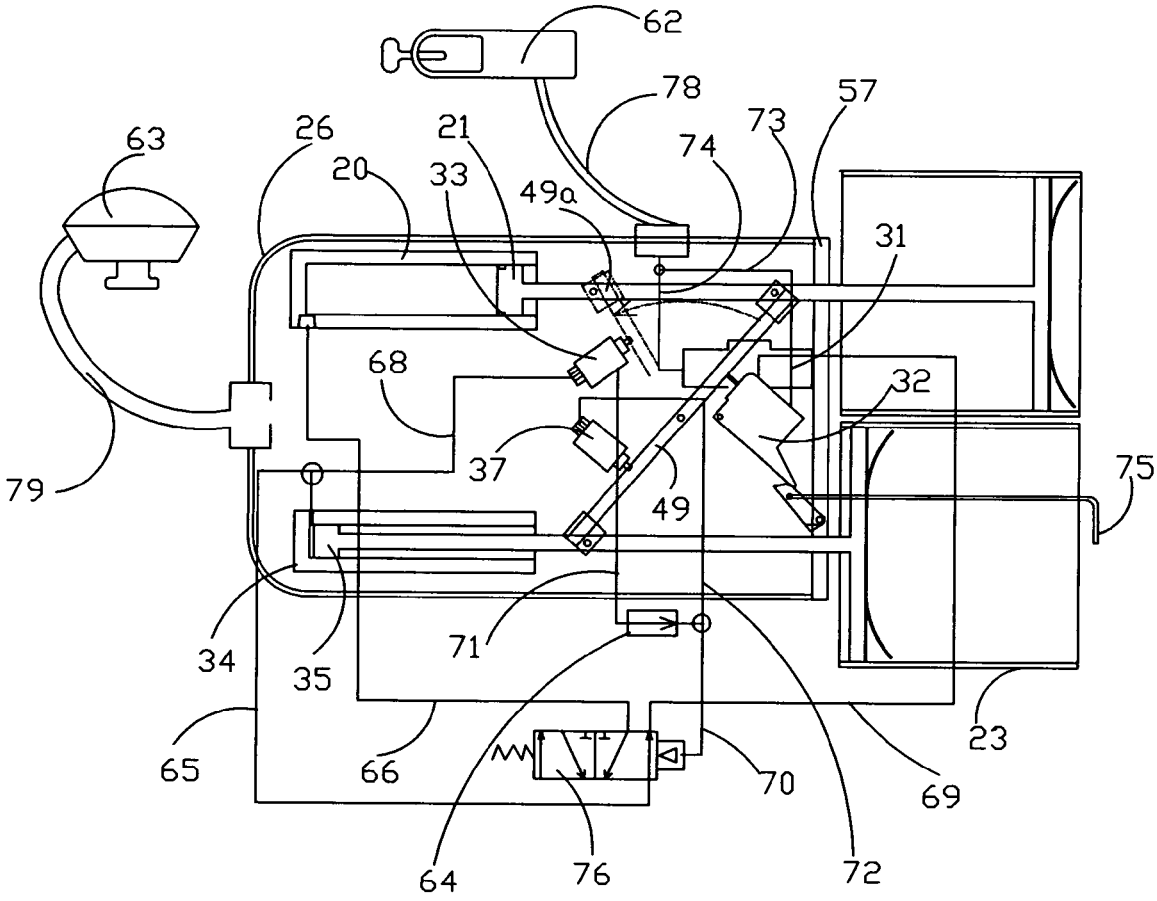
FIG. 4 is a pneumatic interconnection diagram of my invention

Large cylinder 20, small cylinder 34, arm pivot 36, and valves 32, 37, 33, shown in FIG. 4 can all be attached to a mounting bracket 67 using standard hardware.

Fill Valve 32

Figure 6:
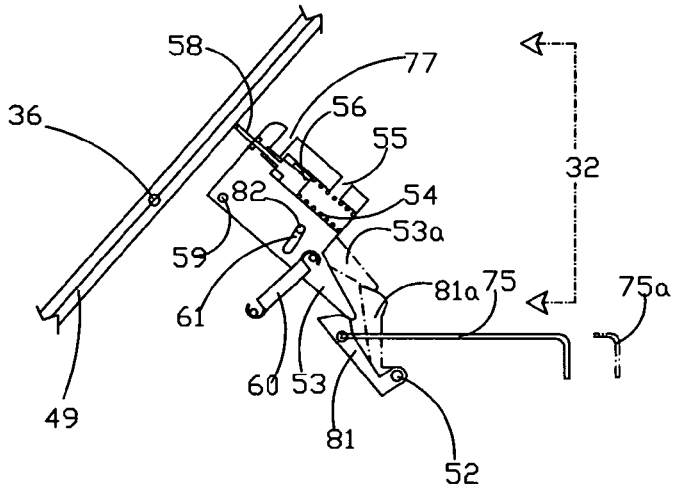
FIG. 6 shows component details of the fill valve assembly used in my invention.

A fill valve 32 shown in FIGS. 4 and 6 and it's position relative to rotating arm 49 determines how much high pressure air from first stage regulator 62 is applied to small cylinder 34. No high pressure air may be applied to small cylinder 34 (representing motor off state). High pressure air may be applied for only a short length of small piston 35 travel (on the order of one half inch)(representing motor speed "slow" condition). Or high pressure air may be applied for a relatively long length of small piston 35 travel (on the order of one inch)(representing motor speed "fast" condition). As will be shown, motor speed conditions can be varied by the diver at will from "off" to "slow" to "fast".

Fill valve 32 rotates about a fill pivot 59 by action of a throttle cam 81. The limits of fill valve 32 rotation is constrained by a pin 82 within a travel groove 61.

High pressure air from first stage regulator 62 is conveyed to fill valve 32 via a line port b 55. Exiting high pressure air from fill valve 32 leaves an exit port 77 and is ultimately conveyed to small cylinder 34. When fill valve 32 is on, and motor control conditions allow, high pressure air from fill valve 32 will power the thrust stroke of small piston 35. The longer fill valve 32 is on, the more pressurized air flows into small cylinder 34 and the higher power/speed the motor will have.

Fill valve 32 can be a poppet type valve including a slideable fill poppet b 56 capable of providing a pressure seal within fill valve 32 so normally no pressurized air can flow from line port b 55 to exit port 77. However, when a poppet pin 58 is pushed by rotating arm 49, fill poppet b 56 also moves breaking the pressure seal and allows pressurized air to pass through fill valve 32. A poppet spring 54 pushes on fill poppet b 56 facilitating a pressure face seal when fill valve 32 is off.

A pivot spring 60 maintains fill valve 32 in a normally "off" condition.

As throttle cam 81 rotates about a cam pivot 52, a valve lobe 53 part of fill valve 32 rotates fill valve 32 further toward or away from rotating arm 49. In FIG. 6, fill valve 32 is shown when poppet pin 58 does not touch rotating arm 49 (shown at it's extreme travel position). With fill valve 32 and throttle cam 81 at this position the motor is "off" (not running).

As throttle cam 81 rotates to a position shown as 81*a*, valve lobe 53 also rotates to a position shown as 53*a* and moves poppet pin 58 toward rotating arm 49. This condition is a motor "on" state.

The further throttle cam 81 is rotated, the faster and more powerful will run the motor. Throttle cam's 81 rotational position is controlled by the diver as simply as connecting a throttle connection 75 linkage rod from throttle cam 81 to some position on the propulsion vehicle where a diver can access/push/pull throttle connection 75 at will. Throttle cam 81 position shown as 81*a* results when diver moves throttle connection 75 to position 75*a*.

Pneumatics/Valves

FIG. 4 shows an embodiment of pneumatics, valves, and interconnections for my invention. Note a spool valve 76 is shown in it's spring return position (pilot off). Spool valve 76 can also shift to it's second position whenever pressurized air is applied via a tube e 70 to it's valve pilot.

My invention shown is at state where small piston 35 is about to begin it's power/thrust stroke.

High pressure air from first stage regulator 62 is conveyed via high a pressure hose 78 through main housing 26 and a tube h 73 to fill valve 32. Fill valve 32 is on/open (because of poppet pin 58 contact with rotating arm 49 see also FIG. 6). High pressure flows through fill valve 32, through a tube d 69, through spool valve 76, through a tube a 65, and into small cylinder 34. Small piston 35 is forced forward by the high pressure air. Fill valve 32 remains "on" as small piston 35 advances a selected distance. Throughout this selected distance, fill valve 32 supplies pressurized air to small cylinder 34 until rotating arm 49 rotates far enough to lose contact with poppet pin 58 and shuts off fill valve 32. As mentioned before, throttle connection 75 positions/controls when this fill valve 32 shut off condition occurs (i.e. how long fill valve 32 keeps supplying pressurized air to small cylinder 34).

As small piston 35 thrusts forward, rotating arm 49 rotates and returns large piston 21. Air contained within large cylinder 20 exhausts through a tube b 66, and through spool valve 76 exhausting into main housing 26.

At the end of small piston 35 thrust stroke, rotating arm 49 moves to position shown as 49*a*. At position 49*a*, a pilot fill valve 33 is opened supplying pressurized air from small cylinder 34 through a tube c 68, through a tube f 71, through a check valve 64, to the pilot of spool valve 76. The pilot shifts spool valve 76, conveying small cylinder 34 high pressure air through tube b 66 to large cylinder 20. Large cylinder 20 pressurization (from small cylinder 34) forces large piston 21 forward on it's power/thrust stroke, and also returns small piston 35.

As large piston 21 travels forward, large cylinder 20 pressure decreases steadily and can become less than the minimum pressure required to shift spool valve 76 pilot. However, the one way check valve 64 maintains high pilot pressure until near the end of large piston 21 travel. At the end of large piston 21 travel, rotating arm 49 actuates a pilot dump valve 37. Pilot dump valve 37 exhausts pilot air through a tube g 72. When the pilot pressure of spool valve 76 is relieved by pilot dump valve 37, spool valve 76 shifts back to it's spring return normalized position as shown in FIG. 4. After this happens, all controls are prepared for the next motor cycle as just described above.

As the dual piston compound motor operates, exhausted air from large cylinder 20 collects in main housing 26 with each cycle of the motor. A scuba diver can breathe air from main housing 26 through a breathing hose 79 and a demand regulator 63. If main housing 26 pressure ever falls below the design pressure limit (as discussed above 3-10 psig), pressure regulator 31 will supply air from high pressure hose 78 through a tube i 74, through pressure regulator 31 and into main housing 26 until pressure exceeds the minimum design pressure limit (3 psig).

First stage regulator 62 can be any one of many commercial diving regulators adjustable to the output pressure of 200 psig. One source of a suitable first stage regulator 62 is model Conshelf XII manufactured by US Divers Co., 3323 West Warner Ave., Santa Ana, Calif. 92702.

Demand regulator 63 can be a commercial hookah low pressure type. One such manufacturer of both demand regulator 63 and breathing hose 79 is Sea Hornet, 1 Kenneth Road, Manly Vale, 2093 NSW Australia. This demand regulator 63 also includes an integral one way valve to keep water from ever going into main housing 26 if main housing 26 is left un-pressurized. The poppet valves 32, 33, 37 are typical valves used by those skilled in the art of pneumatics controls. The poppets of these valves can be made from polyurethane material to effect face pressure seals.

A source for spool valve 76 can be model 1800 available from MAC Valves Inc., Wixom, Mich.

Check valve 64 can be obtained from McMaster Carr, 6100 Fulton Industrial Blvd., Atlanta, Ga. 30336, part number 7768K11.

Main housing 26 can be made from a layered composite material about ⅛ inch thick such as fiberglass and epoxy. A gasket seal (not shown) can be placed between a mounting plate 57 and a flange formed on the main housing 26 to effect a pressure seal. This pressure seal is necessary as main housing 26 pressure is designed to be about 3 to 10 psig above that of the surrounding water.

Small cylinder 34 and small piston 35 will begin their thrust stroke at first stage regulator 62 pressure of 200 psig. At the end of the small piston 35 stroke, the small cylinder 34 pressure will be about 57 psig (depending on throttle cam 81 selected position of FIG. 6).

As discussed, at the end of small piston 35 stroke, pressurized air within small cylinder 34 will be conveyed to large cylinder 20. Accordingly, large cylinder 20 pressure at the beginning of large piston 21 thrust stroke will also be about 57 psig and will decrease with large piston 21 stroke to about 15 psig (it's exhaust pressure).

As designed, the dual piston compound motor meets the former criteria for an effective air motor which both supplies adequate diver propulsion and consumes less air than a diver normal breathing consumption!

I claim:

1. A propulsion means for transporting a diver using a scuba tank containing pressurized air comprising:

a towing device including a pressurizable reservoir, said towing device includes a dual cylinder compound motor powered from said scuba tank containing pressurized air, said dual cylinder compound motor includes a small piston operating within a small cylinder and a large piston operating within a large cylinder, a linkage means interconnecting said small piston and said large piston so one piston is urged to return as the other piston thrusts forward, said dual cylinder compound motor is attached to a dual paddle and flapper valve water thrusting means which propels said towing device, a breathing means capable of supplying sufficient diver breathing air is plumbed to said pressurizable reservoir, said breathing means utilizes air that has previously powered said dual cylinder compound motor whereby almost no air from said scuba tank containing pressurized air is wasted from powering said dual cylinder compound motor.

2. Device according to claim 1, including a moveable valve means which diver can move away from or toward said linkage means to control the quantity of air from said scuba tank containing pressurized air that powers each thrust stroke of said small piston whereby said towing device speed and power is varied.

3. Device according to claim 1, including a pressure regulator means in conveyance with surrounding water, with said scuba tank containing pressurized air, and with said pressurizable reservoir, so that said pressure regulator means maintains a range of air pressure within said pressurizable reservoir by supplying air to said pressurizable reservoir or exhausting air from said pressurizable reservoir when said range of air pressure is exceeded.

4. Device according to claim 1, including a pilot pressure shifting spool valve in conveyance with said small cylinder and said large cylinder whereby pressure from said small cylinder at the end of said small piston stroke is conveyed to said large cylinder at the beginning of said large piston stroke.

* * * * *